United States Patent [19]

Moen

[11] 4,050,587

[45] Sept. 27, 1977

[54] HOIST AND DOLLY APPARATUS

[76] Inventor: George A. Moen, 827 W. 26th Ave., Anchorage, Alaska 99503

[21] Appl. No.: 714,305

[22] Filed: Aug. 16, 1976

[51] Int. Cl.[2] ..... B66C 23/06

[52] U.S. Cl. ..... 212/59 R; 212/8 R; 214/394; 214/1 D; 254/139.1

[58] Field of Search ..... 248/167; 214/392, 394, 214/396, 390, 330–333, 1 D, 75 H, 15 W; 5/83, 87, 88; 280/81 R, 80 R; 108/115, 130; 182/65, 2, 127; 254/2 R, 2 B, 4 R, 4 B, 136, 166, 139.1; 212/8 R, 59 R, 12–14

[56] References Cited

U.S. PATENT DOCUMENTS

| | | | |
|---|---|---|---|
| 1,961,119 | 5/1934 | Ettinger | 254/139.1 |
| 2,449,501 | 9/1948 | Oertle | 212/13 |
| 2,546,362 | 3/1951 | Graham | 212/12 |
| 2,615,584 | 10/1952 | Adams | 212/59 R |
| 2,706,120 | 4/1955 | Stratton | 214/390 |
| 2,821,406 | 1/1958 | Hoyer et al. | 254/2 R |
| 2,903,238 | 9/1959 | Flandrick | 214/1 D |
| 3,019,918 | 2/1962 | Keener | 214/75 H |

FOREIGN PATENT DOCUMENTS

| | | | |
|---|---|---|---|
| 619,042 | 3/1949 | United Kingdom | 212/13 |

*Primary Examiner*—Lawrence J. Oresky
*Attorney, Agent, or Firm*—Lawrence E. Laubscher

[57] ABSTRACT

A hoist and dolly apparatus is disclosed which is adapted to straddle, raise, and transport an object relative to a horizontal surface. The apparatus is characterized by the provision of a horizontal center bar member, and a pair of generally U-shaped leg means pivotally connected with each end of the center bar member, respectively, for pivotal movement about vertical pivot axes toward positions affording increased stability to the apparatus during lifting and transport of the object. Lifting means including boom and cable winch means are connected with the central portion of the horizontal center bar member for raising the object and suspending it at an elevated position for transport relative to the horizontal surface. Locking means are provided for locking the wheels, the leg means, and the lifting means in selected positions relative to the center bar member for maximum stability and ease of transport.

5 Claims, 7 Drawing Figures

HOIST AND DOLLY APPARATUS

BRIEF DESCRIPTION OF THE PRIOR ART

The combination of a dolly structure and lifting means for raising and transporting objects relative to a horizontal surface is well known in the patented prior art, as evidenced, for example, by the patents to Lynn U.S. Pat. No. 3,262,590, Meyer U.S. Pat. No. 3,275,296, and Miller U.S. Pat. No. 3,446,366, among others.

While the known devices normally operate quite satisfactorily, they often lack the versatility required for lifting and transporting objects of various sizes, shapes, and weights. While the structure disclosed in the Lynn patent may be positioned to straddle a particular object to be lifted, neither it nor the apparatus disclosed in the Miller patent include pivotable boom lifting means, nor do they include pivotally connected leg means which may be aligned to straddle an object to be lifted. The apparatus disclosed in the Meyer patent also lacks pivotally connected leg means and is suitable only for lifting light-weight objects because the device does not straddle the object to be lifted.

SUMMARY OF THE INVENTION

The present invention was developed to provide an improved hoist and dolly structure which may be readily assembled and disassembled at a work site and is adapted to lift and transport objects of various shapes such as motors, pumps, pipes or the like. In addition, the device may be operable to straddle larger machinery for lifting selected components therefrom for transport to other locations.

The primary object of the present invention is to provide a hoist and dolly apparatus including a horizontal center bar member, and generally U-shaped, wheeled leg means pivotally connected with each end of said center bar member for movement about vertical pivot axes, whereby the apparatus may be readily transported to a straddling position relative to an object to be lifted. More particularly, the apparatus of the present invention may be positioned over the object to be lifted so that the center of gravity of the object may be aligned as closely as possible with the center of gravity of the dolly structure. Thus, after the dolly structure has been positioned to straddle an object to be lifted, the leg means at each end of the horizontal center bar member may be pivoted about their vertical pivot axes in opposite directions to define a "toed-out" or "wedge" configuration, whereby the stability of the dolly structure is greatly increased during the subsequent lifting and transport of the object.

In accordance with a further object of the invention, the lifting means are pivotable about both horizontal and vertical pivot axes to assist in raising the object to be lifted.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
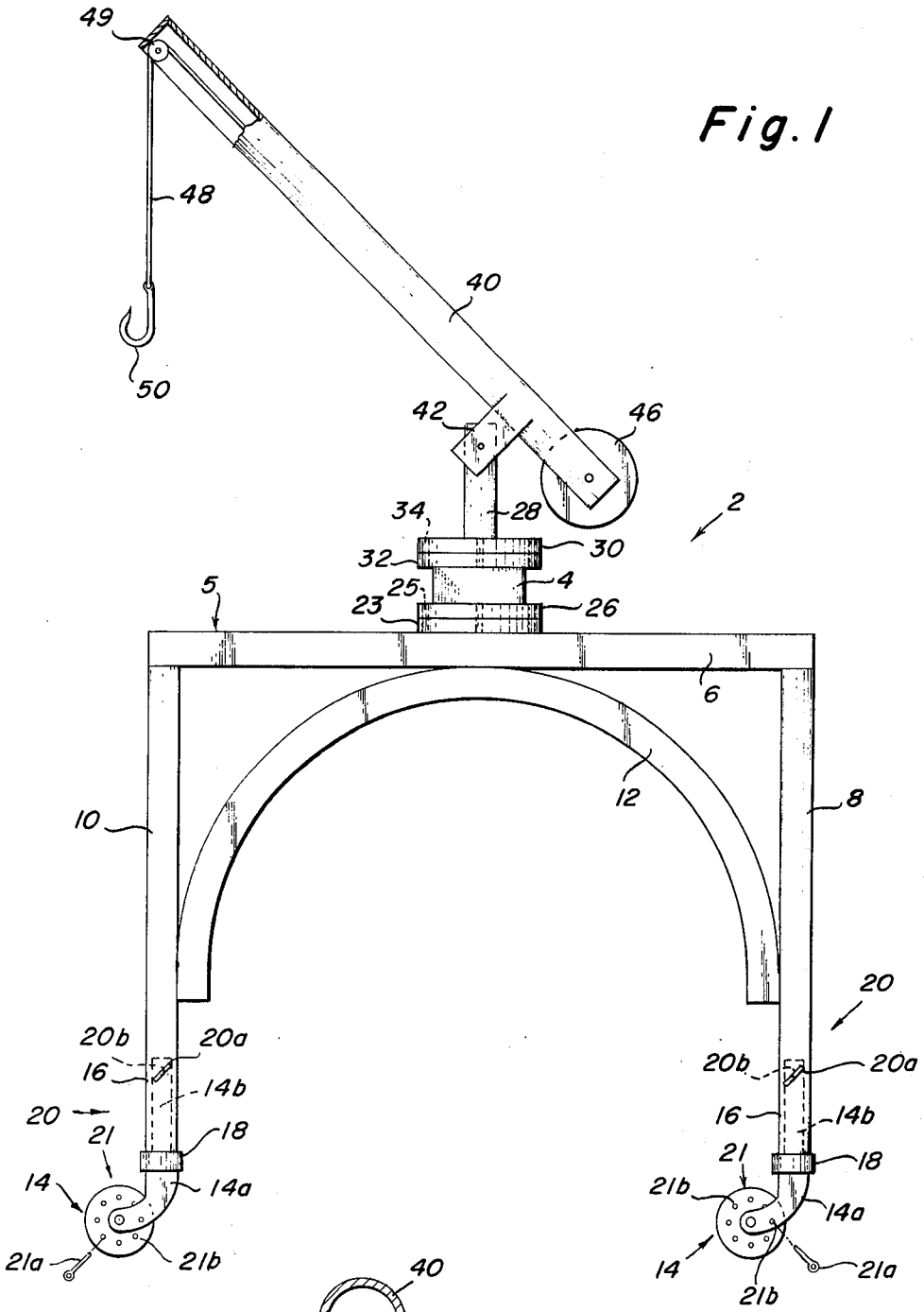
FIG. 1 is a front elevational view of the hoist and dolly apparatus of the present invention.

Referring first more particularly to FIG. 1, the hoist and dolly apparatus 2 of the present invention includes a center bar member 4 and a pair of generally U-shaped leg means 5 pivotally connected with the ends of the center bar member, respectively. Each of the leg means includes a horizontal portion 6 and a pair of leg portions 8 and 10 depending downwardly from the ends of said horizontal portion 6, respectively. In the preferred embodiment, each of the leg means further includes a rigid unitary curved U-shaped brace bar 12 which is secured (for example, by welding) between intermediate portions of the leg portions 8 and 10 and the horizontal portion 6. The center bar member 4, the horizontal and leg portions 6, 8 and 10 of the leg means, and the brace bar member 12 are each preferably constructed from one or more hollow metal pipes. At the lower extremity of each leg portion is provided wheel means 14 including a frame **14*a* having an upwardly extending tubular portion 14*b* which is rotatably mounted within the open end of the associated leg portion. A flange 18 on the wheel means limits the extent of insertion of the portion 16 within the open end of the leg portion. Locking means 20 of the pin and aligned aperture type are provided for locking the wheel tubular portion 16 within the associated leg portion so that upon proper adjustment, all of the wheel means 14 may be locked in positions in which their axes are parallel to permit linear transport of the dolly apparatus. The locking means 20 normally comprises a pin 20*a* adapted to pass through selected aligned holes 20*b* in the leg and wheel portions. Further wheel locking means 21 including locking pin 21*s* and apertures 21*b*** prevent rotation of the wheels relative to the wheel frame to maintain the apparatus in a stationary position during the lifting operation.

Figure 3:
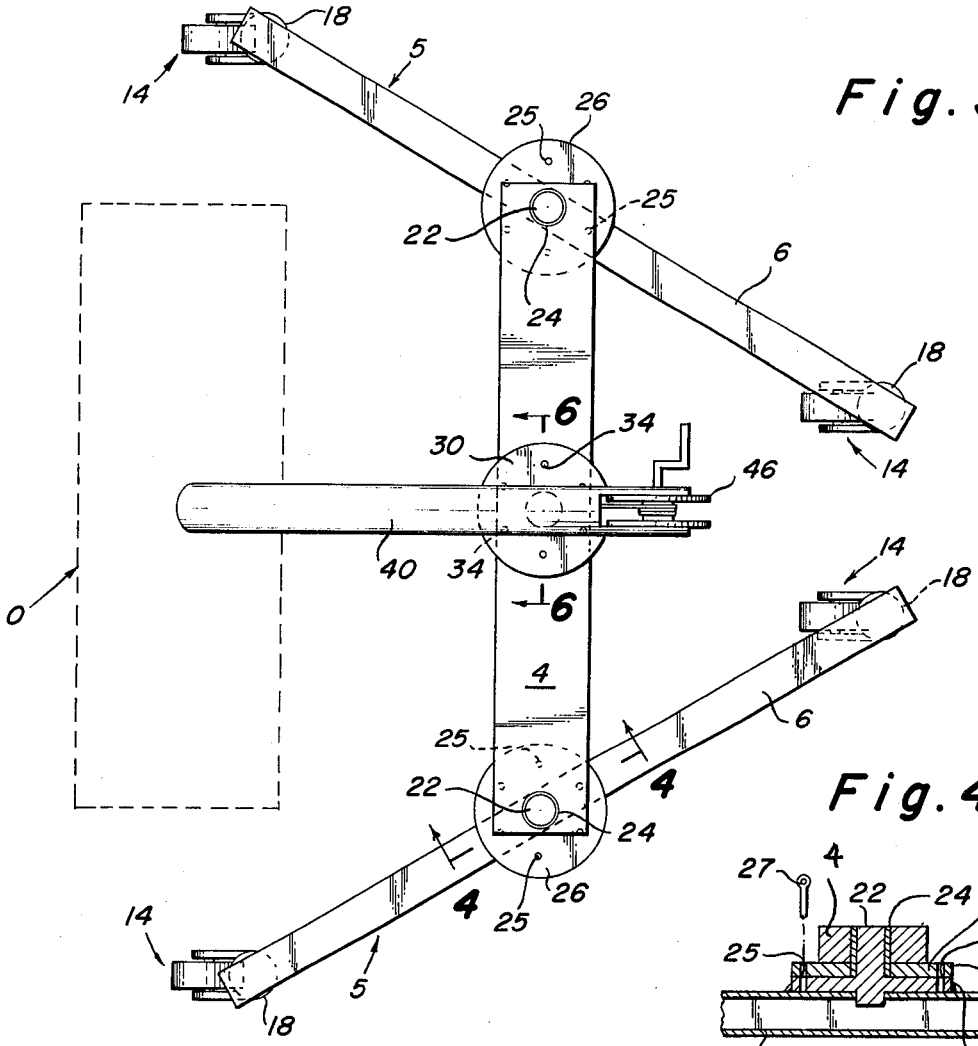
FIG. 3 is a top plan view of the apparatus illustrated in FIG. 1 with the leg means rotated in opposite directions toward positions defining a toed-out wedge configuration.
Figure 4:
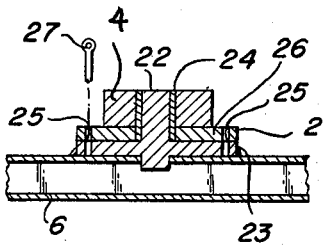
FIG. 4 is a detailed sectional view taken along line 4—4 of FIG. 3.

The pivotal connection between the leg means 5 and the center bar member 4 is best shown in FIGS. 3 and 4. Secured adjacent the center of the horizontal portion 6 of each of the leg means is an upwardly extending stub shaft 22 that is received in a corresponding bearing sleeve 24 contained within an opening at one end of the center bar member. Each bearing sleeve 24 has a diameter slightly greater than the diameter of the corresponding stub shaft 22. Each of the stub shafts 22 includes adjacent and spaced from its upper extremity a flange portion 23 which contains a plurality of apertures 25. Mounted on the bottom of the center bar member 4 concentrically about each of the bearing sleeves 24 is a lower center bar flange 26 which contains a plurality of apertures corresponding with the apertures 25. Leg locking means including a locking 26 similar to wheel locking means 20 are provided at each of the pivotal connections between the center bar member 4 and the leg means for locking the leg means in a desired angular relationship relative to the center bar member, respectively.

Figure 5:
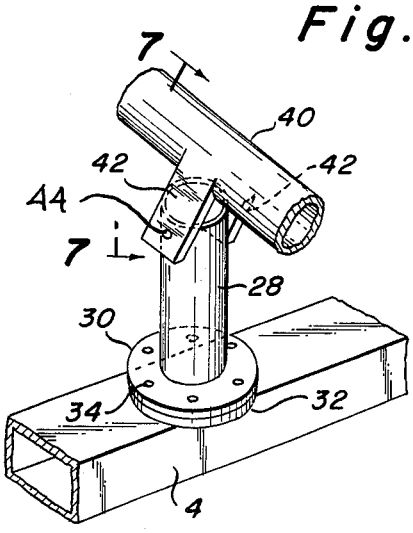
FIG. 5 is a detailed perspective view illustrating the connection of the lifting means with the center bar member.
Figure 6:
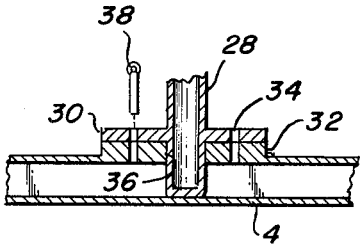
FIG. 6 is a sectional view taken along line 6—6 of FIG. 3.

FIGS. 5 and 6 illustrate the pivotal connection of the lifting means with the center portion of the center bar member. A hollow, cylindrical connecting post 28 includes adjacent and spaced from its lower extremity a flange portion 30 which contains a plurality of apertures 34. The lower extremity of the connecting post rotates within an opening 36 contained in the center portion of the center bar member 4. Mounted on the top of the center bar member 4 concentrically about the opening 36 is an upper center bar flange 32 which contains a plurality of apertures corresponding with the apertures 34. The lifting means is mounted on the dolly structure by inserting the connecting post 28 into the opening 36 in the top of the center bar member 4 until the connecting post flange 30 comes to rest against the center bar flange 32. The connecting post 28 is pivoted to a desired position in which the apertures 34 of the respective flanges are in alignment, whereupon a locking pin 38 is inserted into an aligned pair of apertures to prevent further pivotal movement of the connecting post with respect to the center bar member.

Figure 7:
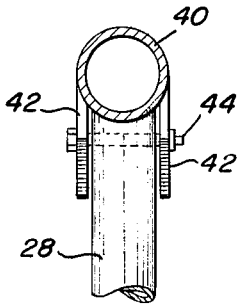
FIG. 7 is a detailed sectional view of the boom connecting means taken along line 7—7 of FIG. 5.

FIGS. 5 and 7 illustrate the connection of the hollow cylindrical lifting boom 40 with the connecting post 28. Depending from the side edges of the lifting boom 40 are trunnion means 42 which are spaced apart a distance slightly greater than the outer diameter of the connecting post. A fastener such as bolt 44 connects the trunnion means 42 with the connecting post 28 to allow pivotal movement about a horizontal pivot axis, whereby the boom may be pivotally elevated or lowered, as desired.

Figure 2:
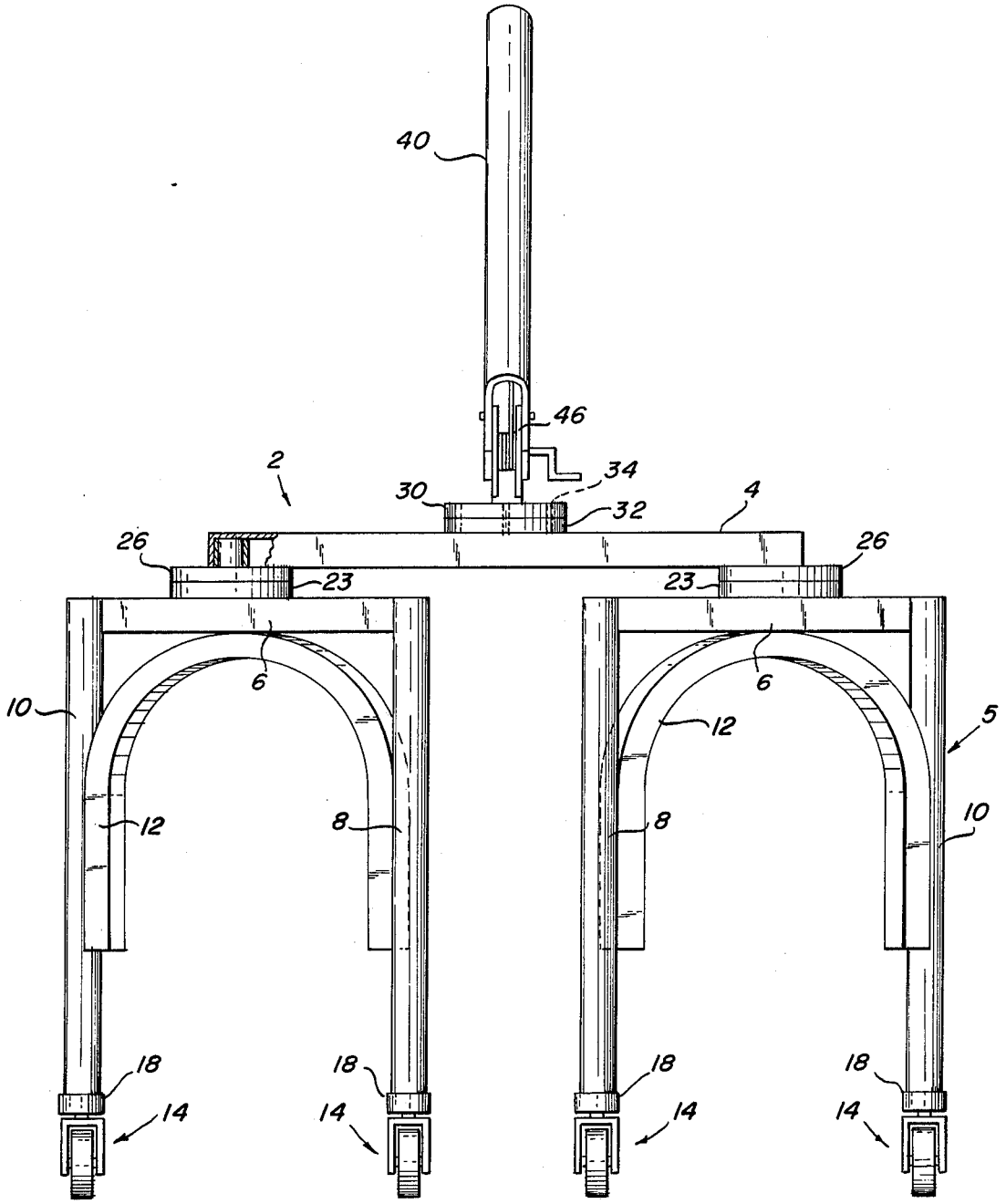
FIG. 2 is a side elevational view of the apparatus illustrated in FIG. 1.

Referring now to FIGS. 2 and 3, there is connected with the lower end of the lifting boom 40 winch means 46 including a cable 48 which extends through the interior of the boom 40 and passes over a pulley 49 at the upper open end of the boom. Connected with the end of the cable is a conventional grasping means, such as hook 50.

OPERATION

In operation, assume that the hoist and dolly apparatus has been assembled by inserting the stub shaft 22 of the leg means into the bearing sleeves 24 at the ends of the center bar member 4. The connecting post 28 of the lifting means is then inserted into the opening 36 in the center bar member, whereupon the apparatus is ready for use.

The dolly structure is rolled longitudinally to straddle an object to be lifted so that the object is received beneath the brace bar 12 and between the leg portions 8 and 10 of the leg means. Alternatively, the dolly may be transported laterally so that the object is received beneath the center bar member 4 between the ends thereof.

In the preferred embodiment illustrated in FIG. 3, when an oversized object is to be lifted and transported, the leg means are pivoted about their vertical pivot axes in opposite directions toward toed-out positions, so that the straddling space beneath the dolly is larger at one side than at the other. When positioned over the object, the leg locking pins 27 are inserted in apertures 25 to lock the leg means in the desired position. The wheel locking means 20 and 21 are inserted in their respective apertures to lock the wheel in a static condition for the lifting operation. With the wheels and leg means locked into position, the boom is next positioned with the hook 50 over the ovject. Locking pin 38 is inserted into an aligned pair of apertures 34 and the bolt 44 is tightened to secure the boom in place. The hook 50 is then connected with the object, and the cable and winch means are operated to lift the object for transport.

The toed-out positioning of the leg means as illustrated in FIG. 3 is also beneficial for raising unusually heavy objects, owing to the toed-out wedging action provided by the leg means. As the object is lifted, its weight is distributed more evenly among the wheel means 14 to prevent the dolly structure from tipping over.

Although in accordance with the Patent Statutes the invention has been illustrated in its preferred form, it will be apparent to those skilled in the art that various changes and modifications may be made without deviating from the inventive concepts set forth above.

What is claimed is:

1. A hoist and dolly structure for raising and transporting an object relative to a horizontal surface, comprising
   a. a horizontal center bar body member (4);
   b. unitary leg means (5) arranged at each end of said body member for supporting the same relative to a fixed surface, each of said leg means including
      1. a U-shaped leg member having a pair of vertical leg portions (8, 10), and a horizontal bridging portion (6) connected between the upper ends of said leg portions, the length of said leg portions being at least as great as the length of said bridging portion; and
      2. a unitary U-shaped brace bar (12) having a curved central portion connected with the center of said bridging portion, and a pair of downwardly depending arm portions connected intermediate the ends of said leg portions;
   c. means (22) pivotally connecting the bridging portions of said leg means with opposite ends of said body member for pivotal movement about vertical pivot axes, respectively;
   d. wheel means (14) connected with the free lower ends of each of said leg portions, respectively; and
   e. lifting means connected with the center portion of said body member for raising the object relative to the horizontal surface, whereby the dolly structure may be transported either laterally or longitudinally in straddling relation to a position above said object, whereupon the object may be lifted by said lifting means for transport by said hoist and dolly structure.

2. Apparatus as defined in claim 1, and further including first locking means (25, 27) for securing the horizontal portions of each of said leg means in a given angular relation relative to said body member, respectively, whereby the leg means at opposite ends of the body member may be pivoted in opposite directions and locked in angularly arranged toed-in relation to stabilize the dolly structure during the lifting and transport of the object.

3. Apparatus as defined in claim 2, wherein each of said wheel means includes a wheel frame (14*a*) rotatably connected with the lower extremity of the associated leg portion for rotation about a vertical axis, and a wheel (14) connected with said wheel frame for rotation about a horizontal axis, said wheel means further including second locking means (20) associated with each of the ends of said leg portions, respectively, for locking the associated wheel frame in a given orientation relative to said leg portion, and third locking means (21) associated with each of the wheels of said wheel means for preventing rotation of the wheel with respect to the wheel frame.

4. Apparatus as defined in claim 2, wherein said lifting means includes a. A connecting post (28) pivotally connected with said body member for pivotal movement about a horizontal pivot axis;

b. a hollow boom (40) and trunnion means (42) connecting said boom with said connecting post for pivotal movement about a horizontal pivot axis; and c. cable winch means including a winch (46) mounted on said boom adjacent the pivotal connection of said boom with said connecting post and a cable (48) which extends through said boom and extends outwardly from the free end thereof, whereby the free end of the cable may be connected with the object for raising and suspending it in an elevated position relative to the horizontal surface.

5. Apparatus as defined in claim 4, wherein said body and leg members are formed from hollow metal pipes.

* * * * *